US010401000B1

(12) United States Patent
George et al.

(10) Patent No.: US 10,401,000 B1
(45) Date of Patent: Sep. 3, 2019

(54) TRAFFIC CONTROL DEVICE WITH WIND DAMPENING BACKPLATE ASSEMBLY

(71) Applicant: Pelco Products, Inc., Edmond, OK (US)

(72) Inventors: Kennith E. George, Edmond, OK (US); Angela R. Stussi, Edmond, OK (US); Stephen P. Parduhn, Edmond, OK (US)

(73) Assignee: Pelco Products, Inc., Edmond, OK (US)

( * ) Notice: Subject to any disclaimer, the term of this patent is extended or adjusted under 35 U.S.C. 154(b) by 0 days.

(21) Appl. No.: 15/906,192

(22) Filed: Feb. 27, 2018

Related U.S. Application Data

(60) Provisional application No. 62/465,504, filed on Mar. 1, 2017.

(51) Int. Cl.
*F21V 15/01* (2006.01)
*G08G 1/095* (2006.01)
*F21W 111/02* (2006.01)

(52) U.S. Cl.
CPC ..... *F21V 15/012* (2013.01); *G08G 1/095* (2013.01); *F21W 2111/02* (2013.01)

(58) Field of Classification Search
CPC .... F21W 2111/02; F21V 15/012; G08G 1/095
USPC ..... 362/362
See application file for complete search history.

(56) References Cited

U.S. PATENT DOCUMENTS

| | | | | |
|---|---|---|---|---|
| 3,571,791 | A * | 3/1971 | Parduhn | G08G 1/095 116/63 R |
| 3,586,280 | A | 6/1971 | Parduhn | |
| 3,764,099 | A | 10/1973 | Parduhn | |
| 3,854,685 | A | 12/1974 | Parduhn | |
| 4,032,248 | A | 6/1977 | Parduhn et al. | |
| D246,585 | S | 12/1977 | Parduhn | |
| D249,517 | S | 9/1978 | Parduhn | |
| 4,117,456 | A * | 9/1978 | Albrecht | G09F 13/0413 362/196 |
| 4,135,192 | A | 1/1979 | Parduhn | |
| D276,213 | S | 11/1984 | Parduhn | |
| D286,667 | S | 11/1986 | Parduhn | |
| 4,659,046 | A | 4/1987 | Parduhn | |
| 4,691,884 | A | 9/1987 | Parduhn | |
| D328,243 | S | 7/1992 | Parduhn | |
| D329,589 | S | 9/1992 | Parduhn | |
| D335,279 | S | 5/1993 | Parduhn | |
| 5,299,111 | A | 3/1994 | Parduhn et al. | |
| D370,825 | S | 6/1996 | Parduhn | |
| D373,947 | S | 9/1996 | Parduhn | |
| D379,756 | S | 6/1997 | Parduhn | |
| 5,645,255 | A | 7/1997 | Parduhn | |
| 5,935,478 | A | 8/1999 | Parduhn | |

(Continued)

*Primary Examiner* — Christopher M Raabe
(74) *Attorney, Agent, or Firm* — Mary M. Lee

(57) ABSTRACT

A traffic control device, such as a traffic signal light housing, with a resiliently deformable back plate assembly. The backplate assembly comprises side flanges that bend or deform in response to external forces such as high winds and blowing debris. In one embodiment, rigid side flanges include a hinge or joint formed of an elastomeric material. This multi-directional wind-dampening backplate renders the housing more aerodynamic and benefits the entire signal structure, including mast arms, poles, and span wire systems.

19 Claims, 3 Drawing Sheets

(56) References Cited

U.S. PATENT DOCUMENTS

| | | | | |
|---|---|---|---|---|
| 6,204,446 | B1 | 3/2001 | Parduhn | |
| 6,357,709 | B1 | 3/2002 | Parduhn | |
| 7,258,314 | B1 | 8/2007 | Parduhn et al. | |
| 7,523,912 | B1 | 4/2009 | Woods | |
| 7,601,928 | B1 | 10/2009 | Magness et al. | |
| 7,997,546 | B1 | 8/2011 | Anderson et al. | |
| 8,173,904 | B1 | 5/2012 | Parduhn et al. | |
| 8,474,780 | B2 | 7/2013 | Parduhn et al. | |
| 8,875,451 | B1 | 11/2014 | Parduhn et al. | |
| 9,200,654 | B1 | 12/2015 | Parduhn | |
| 9,316,349 | B1 | 4/2016 | Parduhn et al. | |
| 9,322,536 | B1 | 4/2016 | Parduhn et al. | |
| 9,559,275 | B2 | 1/2017 | Kong et al. | |
| 9,933,037 | B1 | 4/2018 | George et al. | |
| 2008/0150758 | A1* | 6/2008 | Vallejo, Sr. ..... | G08G 1/095<br>340/907 |
| 2011/0095162 | A1 | 4/2011 | Parduhn et al. | |
| 2013/0095710 | A1* | 4/2013 | Townsend, Jr. ..... | G08G 1/095<br>439/888 |
| 2016/0210849 | A1 | 7/2016 | Stussi et al. | |

* cited by examiner

TRAFFIC CONTROL DEVICE WITH WIND DAMPENING BACKPLATE ASSEMBLY

CROSS-REFERENCE TO RELATED APPLICATION(S)

This application claims the benefit of U.S. provisional application No. 62/465,504 entitled "Traffic Control Device with Wind Dampening Backplate Assembly," filed Mar. 1, 2017, the contents of which are incorporated herein by reference.

FIELD OF THE INVENTION

The present invention relates to traffic control devices generally and more particularly, but without limitation, to backplates for traffic control devices.

DETAILED DESCRIPTION OF AN EMBODIMENT OF THE INVENTION

Traffic control devices must be easily seen to serve vehicular and pedestrian traffic. To that end, traffic control devices, such as signal housings, often are provided with a surrounding backplate to provide visual contrast for enhanced visibility. Although backplates improve visibility of the signals, they also present additional surface area to external forces such as wind, rain, hail, and flying debris. As a result, increased visibility is accompanied by increased wind resistance and consequently a greater likelihood of damage or detachment.

Attempts have been made to reduce the additional wind load created by backplates. For example, backplates have been provided with perforations or reduced width. However, there remains a need for backplates that minimize wind load without reducing the visibility of the signal.

The present invention provides an improved backplate assembly that reduces wind resistance and therefore the costs and disruptions associated with damage to traffic control devices. In accordance with the present invention, there is provided a backplate assembly that comprises first and second side flanges that are resiliently deformable.

Figure 1:
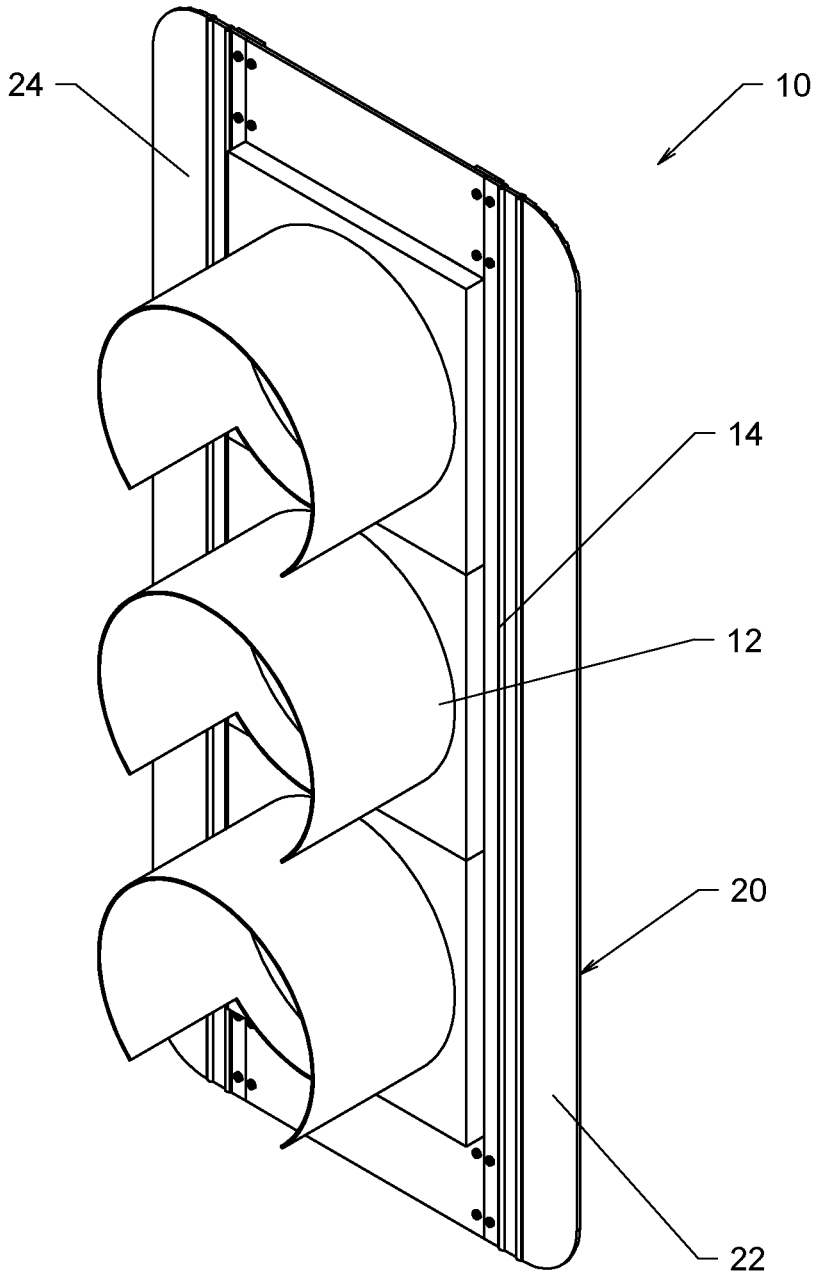
FIG. 1 is a right frontal perspective view of a traffic signal housing with a wind dampening backplate assembly constructed in accordance with an embodiment of the present invention.
Figure 3:
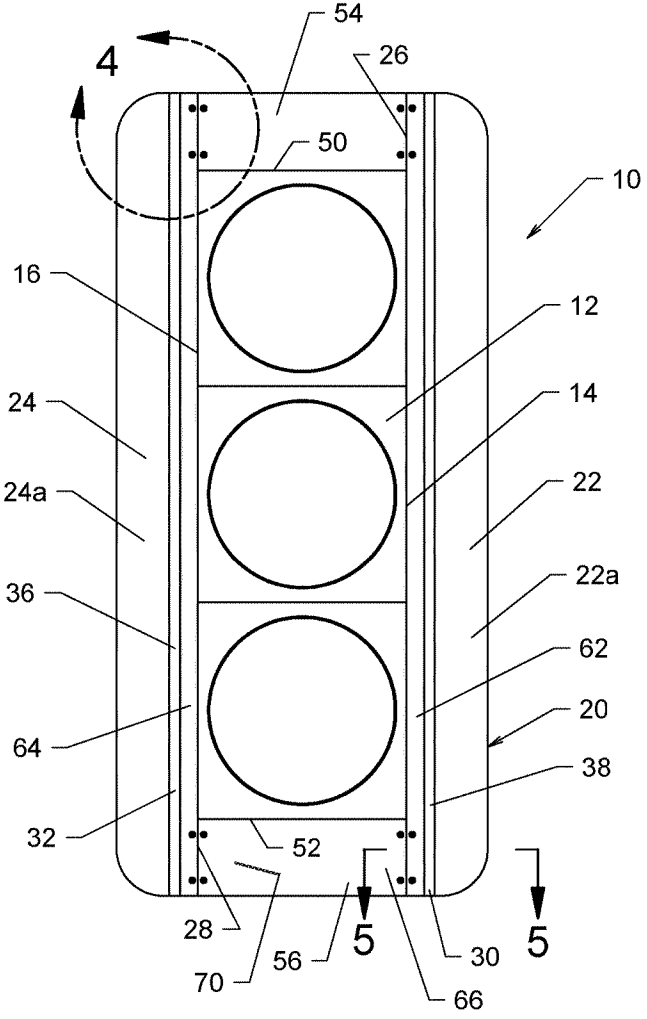
FIG. 3 is a front elevational view of the traffic signal housing shown in FIG. 1.
Figure 2:
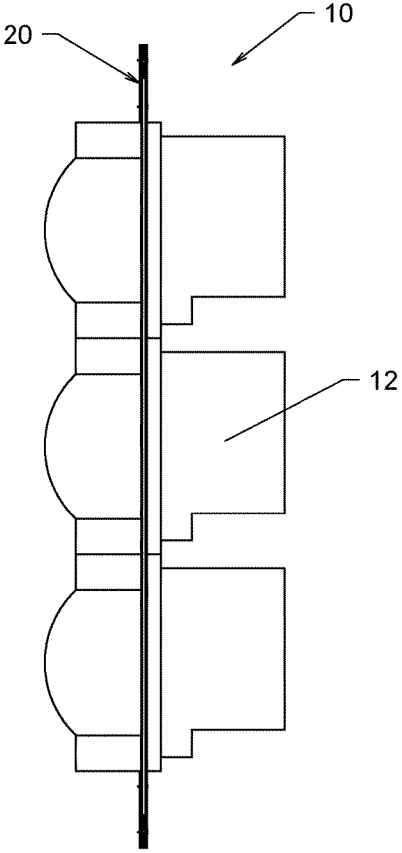
FIG. 2 is a right side elevational view of the traffic signal housing shown in FIG. 1.

Turning now to the drawings in general and to FIGS. 1-3 in particular, there is shown therein a traffic control device equipped with a backplate assembly constructed in accordance with an embodiment of the present invention and designated generally by the reference numeral 10. In the embodiment illustrated here, the traffic signal housing is a traffic signal light but the invention is no so limited.

Generally, the device 10 comprises a housing 12. The shape and configuration and orientation of the housing 12 may vary. In the exemplary embodiment, the housing 12 supports a three-light vertically-oriented traffic signal. The housing 12 has first and second sides 14 and 16 (FIG. 3). In most instances, the sides 14 and 16 are straight and parallel as shown.

The device 10 further comprises a backplate assembly 20. The backplate assembly 20 usually will be sized and colored to provide visual contrast surrounding the signal lights. The backplate assembly 20 comprises first and second flanges 22 and 24. The first flange 22 has an inner edge 26 joined to the first side 14 of the signal housing 12, and the second flange 24 has an inner edge 28 joined to the second side 16 of the signal housing 12. That is, the flanges are attached so that they extend outwardly from the sides of the housing 12. In one embodiment, the connections may be to the back of the housing along the sides 14 and 16 so long as the flanges flank the housing visually when viewed from the front of the device.

In accordance with the present invention, the first and second flanges 22 and 24 are resiliently deformable. As used herein, "deformable" means that the side flanges yield, that is, bend or deflect in response to external forces, such as wind. The degree of flexibility may vary depending on the circumstances. By way of example, as explained more fully hereafter, the side flanges may be formed to remain rigid, that is, resisting bending in response to wind forces of 40 mph or less and to bend only about 45 degrees in response to wind speeds between about 40 mph and 80 mph, and to bend to about 90 degrees in response to wind speeds in excess of about 80 mph.

In the embodiment shown, each of the flanges 22 and 24 comprises an outer section 22*a* and 24*a* made of a rigid material and a flexible section that may comprises a strip of resilient material that forms a hinge or joint. A first joint 30 is provided adjacent the inner edge 26 of the first flange 22, and a second joint 32 is provided adjacent the inner edge 28 of the second flange 24. Now it will be appreciated that, the flanges 22 and 24 will deform in response to wind or other impact by bending forward or rearward at the joints 30 and 32. Alternately, the side flanges could be formed of resiliently deformable material, such as a suitable elastomeric material.

Figure 4:
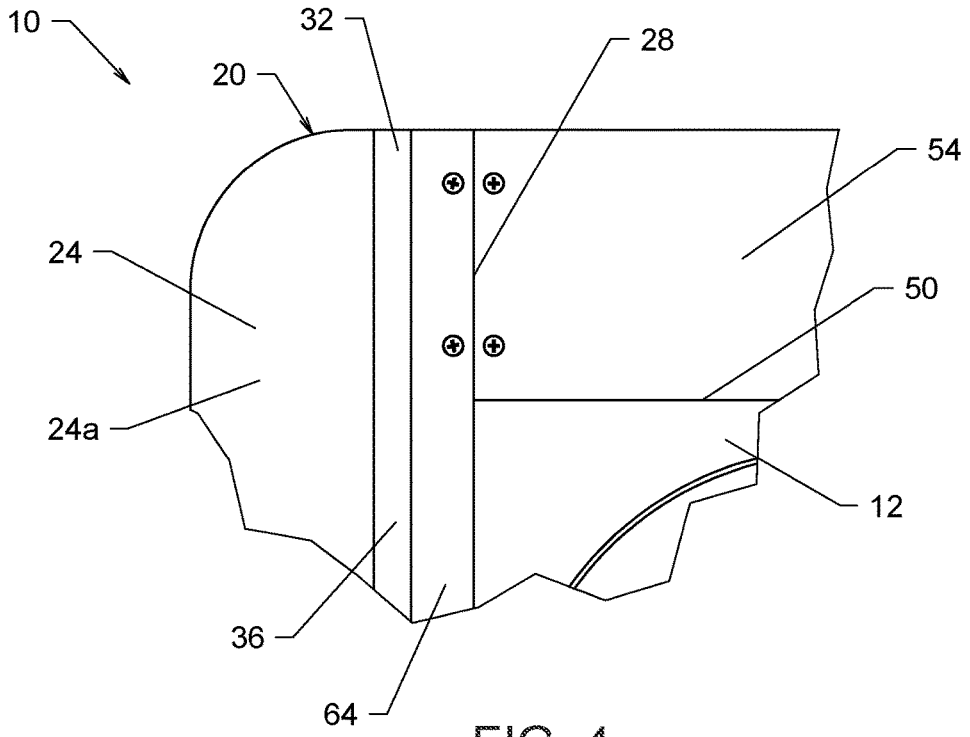
FIG. 4 is an enlarged view of a section designated by the number "4" in FIG. 3.
Figure 5:
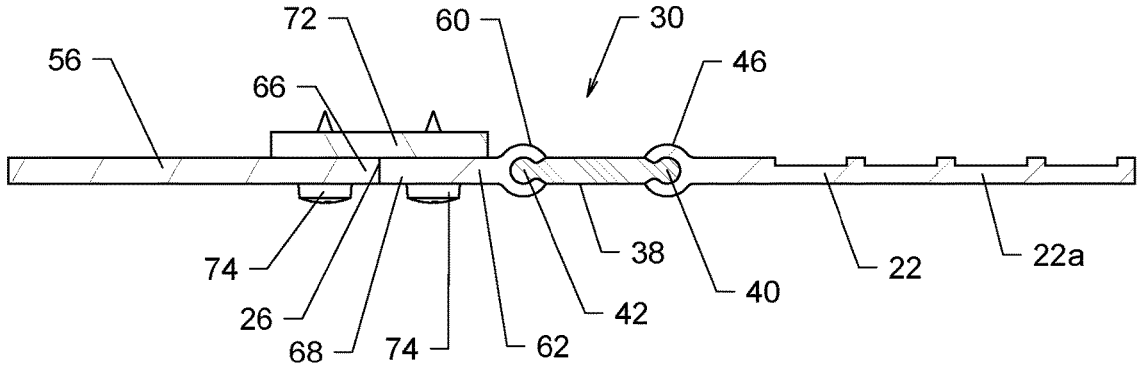
FIG. 5 is an enlarged, fragmented sectional view of the traffic signal housing shown in FIG. 1 taken along line 5-5 of FIG. 3.

Turning now to FIGS. 4 and 5, a preferred structure for the joints 30 and 32 will be described. As both joints 30 and 32 may be identically formed, only the joint 30 will be explained in detail with reference to FIG. 5. The joint 30 preferably comprises an elongate resilient strip 38 running longitudinally the length of the flange 22. The first and second side edges 40 and 42 of the strip 38 form longitudinal beads or ribs. The inner edge 46 of the first flange section 22*a* comprises a groove sized to receive the rib 40. Similarly, the inner edge 60 of an attachment section 62 forms a groove sized to receive the rib 42. Although not shown in detail, the joint 32 comprises a similar elongate resilient strip 36 and attachment section 64, as indicated in FIG. 4.

In a most preferred embodiment, the rigid attachment section, the resilient strip section, and the rigid outer section of each flange is formed by the process of dual durometer extrusion resulting in a chemical and mechanical bond at the interfacing surfaces to produce an integrally formed or unitary structure. Now it will be appreciated that the dual durometer composition will be selected to achieve the desired degree of deflection in relation to specific wind speeds.

In the embodiment shown, the joints 30 and 32 achieve resiliency by the elongate strips 36 and 38 formed of a resiliently deformable material, such as a suitable elastomeric material. Alternately, the resiliency may be provided at least in part by structure. For example, the joint may comprise a leaf and pin style hinge, or the elongate strip could be formed in longitudinal pleats or folds. Still further, the joint may be a saddle joint or pivot joint or other suitable structure that allows the side flanges to bend forward and backward.

In most applications, it will be advantageous for the backplate assembly 20 to extend around the full perimeter of the housing 12. In the illustrative embodiment, the first and second flanges 22 and 24 extend a distance beyond the first and second ends 50 and 52 of the signal housing 12, as best seen in FIG. 3. To provide a continuous surround, the backplate assembly 20 may also comprises first and second connecting sections 54 and 56.

As shown in FIGS. 3-5, the first connecting section 54 extends across the first end 50 of the signal housing 12 between the first and second flanges 22 and 24, and the second connecting section 56 extends across the second end 52 of the signal housing between the first and second flanges. One suitable way of securing the connecting sections 54 and 56 is shown in FIG. 5, although the invention is not so limited. One end 66 of the connecting section 56 is brought into abutment with the inner edge 68 of the attachment strip 62 that forms the inner edge 26 of the flange 22. Similarly, the other end 70 (FIG. 3) of the section 56 abuts the attachment strip 64 that forms the inner edge 28 of the flange 24.

The abutting edges are fixed together by any suitable means. One example of a suitable attachment is the support strip 72 (FIG. 5) secured behind the abutting edges by screws 74 or the like. Alternately, the support strip 72 could be eliminated by overlapping the edges of the attachment strips and the ends of the connecting sections. In the exemplary embodiment, the attachment sections 62 and 64 of the flanges 22 and 24 are bolted or otherwise connected to the housing 12. Still further, the flanges or the connecting sections or all of them could be integrally formed as part of the housing.

While the connection sections 54 and 56 are not designed to bend in this embodiment, in other embodiments the connecting sections may also be resilient or be otherwise deformably attached. Additionally, while the backplate assembly 20 is shown constructed in several parts, the number and configuration of the parts may vary. By way of example, the flanges 22 and 24 and connecting sections 54 and 56 may be integrally formed into a continuous surround made of a resilient material. These and other modifications are within the intended scope of the present invention.

The embodiments shown and described above are exemplary. Many details are often found in the art and, therefore, many such details are neither shown nor described herein. It is not claimed that all of the details, parts, elements, or steps described and shown herein are newly invented. Changes may be made in the details, especially in matters of shape, size, and arrangement of the parts, within the principles of the invention to the full extent indicated by the broad meaning of the terms in the attached claims. The description and drawings of the specific embodiments herein do not point out what an infringement of this patent would be, but rather provide non-limiting examples of how to use and make the invention. Likewise, the abstract is neither intended to define the invention, which is measured by the claims, nor is it intended to be limiting as to the scope of the invention in any way. The limits of the invention and the bounds of the patent protection are measured by and defined in the following claims.

What is claimed is:

1. A traffic control device comprising a housing with first and second sides and comprising a resiliently deformable backplate assembly, the backplate assembly comprising:

a first flange having an inner edge joined to the first side of the signal housing; and a second flange having an inner edge joined to the second side of the signal housing;

wherein the first and second flanges are resiliently deformable.

2. The traffic control device of claim 1 wherein first flange has a length extending between a top end edge and a bottom end edge, wherein the second flange has a length extending between a top end edge and a bottom end edge, wherein the first flange comprises a first joint adjacent the inner edge of the first flange and extending from the top end edge to the bottom end edge, and where the second flange comprises a second joint adjacent the inner edge of the second flange and extending from the top end edge to the bottom end edge.

3. The traffic control device of claim 2 wherein each of the first and second joints of the backplate assembly comprises an elongate resilient strip.

4. The traffic control device of claim 3 wherein the resilient strip of the first joint is integrally formed with the first flange, and the resilient strip of the second joint is integrally formed with the second flange.

5. The traffic control device of claim 4 wherein the first flange comprises a rigid section extending outwardly from the first joint, and the second flange comprises a rigid section extending outwardly from the second joint.

6. The traffic control device of claim 4 wherein each of the first and second joints of the backplate assembly comprises a dual durometer extrusion.

7. The traffic control device of claim 1 wherein each of the first and second flanges of the backplate assembly comprises a dual durometer extrusion.

8. The traffic control device of claim 1 wherein the traffic signal housing has first and second ends, wherein the first and second flanges extend beyond the first and second ends of the signal housing, and wherein the backplate assembly further comprises:

a first connecting section extending across the first end of the housing between the first and second flanges; and a second connecting section extending across the second end of the housing between the first and second flanges.

9. The traffic control device of claim 1 wherein the first and second flanges are formed to resist bending in response to wind forces of 40 mph or less and to bend about 45 degrees in response to wind speeds between about 40 mph and 80 mph and to bend to about 90 degrees in response to wind speeds in excess of about 80 mph.

10. A backplate assembly for a traffic control device, the traffic control device having a housing with first and second side edges, the backplate assembly comprising:

a first flange having an inner edge attachable to the first side of the housing; and a second flange having an inner edge attachable to the second side of the housing;

wherein, when the backplate assembly is attached to the housing, the first and second flanges are resiliently deformable.

11. The backplate assembly of claim 10 wherein first flange has a length extending between a top end edge and a bottom end edge, wherein the second flange has a length extending between a top end edge and a bottom end edge, and wherein the backplate assembly further comprises:

a first joint adjacent the inner edge of the first flange and extending from the top end edge to the bottom end edge; and a second joint adjacent the inner edge of the second flange and extending from the top end edge to the bottom end edge.

12. The backplate assembly of claim 11 wherein each of the first and second joints of the backplate assembly comprises an elongate resilient strip.

13. The backplate assembly of claim 12 wherein each of the first and second joints of the backplate assembly comprises a dual durometer extrusion.

14. The backplate assembly of claim 11 wherein the first flange comprises a rigid section configured to extend outwardly from the first joint when the back plate assembly is attached to the housing, and wherein the second flange comprises a rigid section configured to extend outwardly from the second joint when the back plate assembly is attached to the housing.

15. The backplate assembly of claim 10 wherein each of the first and second flanges of the backplate assembly comprises a dual durometer extrusion.

16. The backplate assembly of claim 15 wherein the first flange comprises a rigid section configured to extend outwardly from the dual durometer extrusion of the first flange when the back plate assembly is attached to the housing, and wherein the second flange comprises a rigid section configured to extend outwardly from the dual durometer extrusion of the second flange when the back plate assembly is attached to the housing.

17. The backplate assembly of claim 12 wherein the first and second resilient strips of each of the first and second joints is formed of resiliently deformable material.

18. The backplate assembly of claim 10 wherein the traffic control device housing has first and second ends, wherein the first and second flanges are sized to extend beyond the first and second ends of the housing, and wherein backplate assembly further comprises:

a first connecting section sized to extend across the first end of the housing between the first and second flanges; and a second connecting section sized to extend across the second end of the housing between the first and second flanges.

19. The backplate assembly of claim 10 wherein the first and second flanges are formed to resist bending in response to wind forces of 40 mph or less and to bend about 45 degrees in response to wind speeds between about 40 mph and 80 mph and to bend to about 90 degrees in response to wind speeds in excess of about 80 mph.

* * * * *